US007703761B2

(12) United States Patent
Shiraki

(10) Patent No.: US 7,703,761 B2
(45) Date of Patent: Apr. 27, 2010

(54) SHEET FEED ROLLER AND METHOD OF MANUFACTURING THE SAME

(75) Inventor: Keita Shiraki, Inuyma (JP)

(73) Assignee: Tokai Rubber Industries, Ltd., Komaki-shi (JP)

( * ) Notice: Subject to any disclaimer, the term of this patent is extended or adjusted under 35 U.S.C. 154(b) by 29 days.

(21) Appl. No.: 11/851,841

(22) Filed: Sep. 7, 2007

(65) Prior Publication Data

US 2008/0061495 A1 Mar. 13, 2008

(30) Foreign Application Priority Data

Sep. 8, 2006 (JP) ..... 2006-244542
May 22, 2007 (JP) ..... 2007-135621

(51) Int. Cl.
*B25F 5/02* (2006.01)
*B65H 3/06* (2006.01)

(52) U.S. Cl. ..... 271/109; 492/30; 492/59; 492/56

(58) Field of Classification Search ..... 271/109, 271/314; 492/30.31, 59, 56, 57
See application file for complete search history.

(56) References Cited

U.S. PATENT DOCUMENTS 3,266,976 A * 8/1966 Brezinski ..... 162/314
3,599,306 A * 8/1971 Brafford ..... 492/30
4,353,296 A * 10/1982 Beucker ..... 100/121
4,880,501 A * 11/1989 Schiel ..... 162/358.4
5,543,015 A * 8/1996 Jermo ..... 162/358.4
5,575,436 A * 11/1996 McDermott ..... 242/542.4
2002/0115545 A1 * 8/2002 Yoshida et al. ..... 492/30
2006/0062599 A1 * 3/2006 Shimmura et al. ..... 399/236

FOREIGN PATENT DOCUMENTS

EP 1 199 274 A3 4/2002
JP 62-65859 A 3/1987
JP 08-188271 A 7/1996
JP 09-183533 A 7/1997
JP 11-106067 A 4/1999
JP 2002-120944 A 4/2002
JP 2004-331248 A 11/2004
JP 2006-160468 A 6/2006

OTHER PUBLICATIONS

UK Search Report dated Nov. 26, 2007, issued in corresponding Application No. GB0717482.4.
Japanese Office Action dated Jul. 24, 2007, issued in corresponding Japanese Application No. 2007-135621.

* cited by examiner

*Primary Examiner*—Patrick Mackey
*Assistant Examiner*—Luis Gonzalez
(74) *Attorney, Agent, or Firm*—Westerman, Hattori, Daniels & Adrian, LLP

(57) ABSTRACT

A sheet feed roller prolonging sustainability of sheet feeding capability even if crushed powders are scattered. The sheet feed roller comprises a hub and an elastic layer provided on an outer peripheral surface of the hub, wherein plural grooves axially extend at specific intervals circumferentially on an outer peripheral surface of the elastic layer, a textured surface comprising mountain portions and a valley portion is formed on an outer peripheral surface of the elastic layer except for the grooves, and on bottom surfaces and wall surfaces of the grooves, a ratio of a total area of the bottom surfaces of the grooves to a total area of the outer peripheral surface of the elastic layer except for the grooves is 10% to 20%.

9 Claims, 4 Drawing Sheets

SHEET FEED ROLLER AND METHOD OF MANUFACTURING THE SAME

BACKGROUND OF THE INVENTION

1. Field of the Invention

The present invention relates to a sheet feed roller, such as a feed roller or a transport roller, for transporting paper in a copying machine, a printer or a facsimile machine.

2. Description of the Art

A sheet feed roller used in a copying machine or the like is generally required to maintain a friction coefficient for a long time. However, paper powders caused by papers accumulate on a surface of the sheet feed roller in repeated sheet feeding, so that a friction coefficient decreases, resulting in the problem that sheet feed capability deteriorates.

Therefore, there have been conventionally proposed sheet feed rollers, which incorporate paper powders into grooves formed axially at specific intervals circumferentially on an outer peripheral surface thereof, or recesses of a textured surface thereof (see, for example, Japanese Unexamined Patent Publication No. 11-106067 and Japanese Patent No. 3744337).

In the meantime, there is a method of follow printing (overprinting) on a color-printed paper, as a printing method. In this case, crushed powders are scattered on a paper surface prior to the follow printing, so as to prevent adherence of overlapping paper sheets to each other. However, when the follow printing is conducted in a state that crushed powders are scattered, the crushed powders adhere to the sheet feed roller, sheet feeding capability deteriorates earlier than usual printing even if the sheet feed rollers (having grooves or a textured surface on an outer peripheral surface thereof) disclosed in the above two publications. For this reason, an exchange cycle of the sheet feed roller is shortened, so that maintenance cost increases.

In view of the foregoing, it is an object of the present invention to provide a sheet feed roller prolonging sustainability of sheet feeding capability even if crushed powders are scattered, and a method of manufacturing the same.

SUMMARY OF THE INVENTION

According to a first aspect of the present invention to achieve the aforesaid objects, there is provided a sheet feed roller comprising a hub and an elastic layer provided on an outer peripheral surface of the hub, wherein plural grooves axially extend at specific intervals circumferentially on an outer peripheral surface of the elastic layer, a textured surface comprising mountain portions and a valley portion is formed on an outer peripheral surface of the elastic layer except for the grooves, and on bottom surfaces and wall surfaces of the grooves, a ratio of a total area of the bottom surfaces of the grooves to a total area except for the grooves on the outer peripheral surface of the elastic layer is 10% to 20%. According to a second aspect of the present invention, there is provided a method of manufacturing the sheet feed roller, comprising the steps of:

forming a cylindrical elastic layer by using a mold; and inserting a hub into a hollow center of the elastic layer for forming the elastic Layer on an outer peripheral surface of the hub;

wherein the mold is obtained by forming a hole penetrating through a metallic block as a space for molding and putting a cylindrical electrode into the hole with oscillating and pushing movements, wherein the cylindrical electrode has plural grooves axially extending at specific intervals circumferentially on an outer peripheral surface thereof, whereby electrical discharge is conducted on an inner peripheral surface of the hole, so that the mold has a rough surface for forming the grooves and the textured surface.

According to the sheet feed roller of the present invention, plural grooves are axially extended at specific intervals circumferentially on an outer peripheral surface of the elastic layer, and a percentage of grooves formed thereon (a ratio of a total area of the bottom surfaces of the grooves to a total area of the outer peripheral surface of the elastic layer except for the grooves) is 10 to 20% Thereby, when the elastic layer of the sheet feed roller is in contact with a paper sheet, the outer peripheral surface of the elastic layer appropriately deforms so as to grip the paper sheet appropriately. Further, since the surface of the elastic layer (the outer peripheral surface except for the grooves, and bottom surfaces and wall surfaces of the grooves) is formed into a textured surface so as to enhance the grip of paper, transportation capability of paper is improved in cooperation of grooves formed at a specific ratio and the textured surface. Still further, crushed powders and paper powders are incorporated into grooves, and then are withdrawn from the textured surface formed on grooves so as to be discharged to the outside of grooves, so that sustainability of sheet feeding capability can be prolonged dramatically.

According to the sheet feed roller of the present invention, since plural grooves are axially extended at specific intervals circumferentially on the outer peripheral surface of the elastic layer, and the cuter peripheral surface of the elastic layer is formed into a textured surface, and the ratio of a total area of the bottom surfaces of the grooves to a total area of the outer peripheral surface of the elastic layer except for the grooves is 10% to 20%, transportation capability of paper is improved in cooperation of grooves formed at a specific ratio and the textured surface, and also crushed powders and paper powders are discharged to the outside of grooves. Therefore, sustainability of sheet feeding capability can be prolonged dramatically.

Especially, when a ratio ($S_1/S_2$) of a total area ($S_1$) of the mountain portions to an area ($S_2$) of the valley portion is 0.25 to 0.70, crushed powders and paper powders are difficult to adhere to the surface (textured surface) of the elastic layer, so that preferable friction coefficient can be obtained.

Further, when the elastic layer has JIS-A hardness of 30° to 60°, moldability of the elastic layer is excellent and also friction coefficient of the elastic layer becomes preferable.

BRIEF DESCRIPTION OF THE DRAWINGS

FIG. 1(*b*) is a side view thereof;

FIG. 4(*b*) is a view illustrating schematically a paper sheet on which the ink is transferred from the jig in the method.

DESCRIPTION OF THE PREFERRED EMBODIMENTS

The present invention will hereinafter be described in detail by way of an embodiment thereof.

Figure 1:
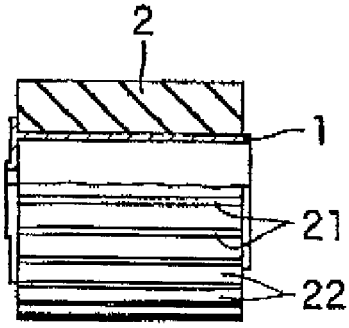
FIG. 1(*a*) is a partial sectional front view illustrating one embodiment of a sheet feed roller according to the present invention.
Figure 1:
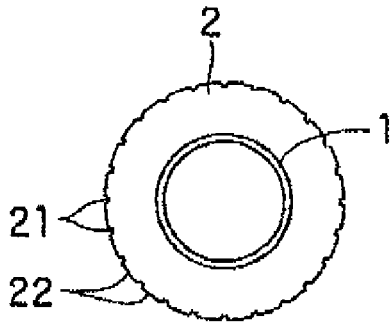
Figure 3:
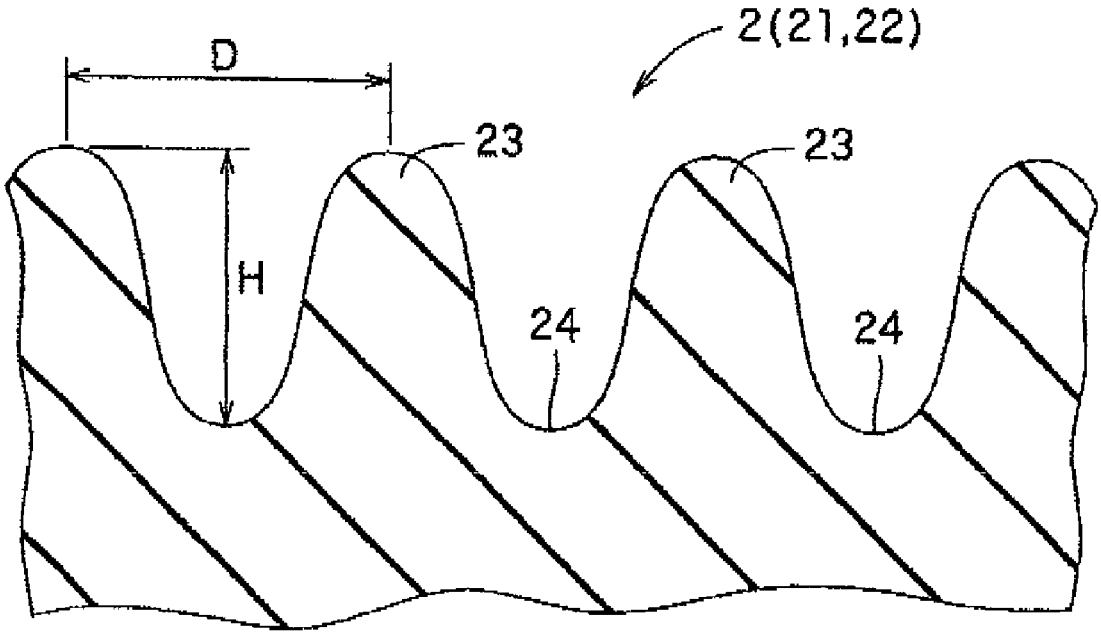
FIG. 3 is a further enlarged sectional view illustrating schematically a surface of the sheet feed roller.

FIGS. 1(*a*) and 1(*b*) show one embodiment of a sheet feed roller of the present invention. The sheet feed roller includes a hub 1 and an elastic layer 2 provided on an outer peripheral surface of the hub 1. As shown in FIGS. 1(*a*), 1(*b*) and 2, plural grooves 21 axially extend at specific intervals circumferentially on an outer peripheral surface of the elastic layer 2. The plural grooves 21 are formed in such a manner that a ratio of a total area of the bottom surfaces of the grooves 21 (hereinafter, just abbreviated to "groove-area ratio") to a total area except for the grooves 21 on the outer peripheral surface of the elastic layer 2 (convex portions 22 between adjoining grooves 21) is 10% to 20%. Further, as shown in FIG. 3, a surface of the elastic layer 2 (including an outer periphery of each convex portion 22 and a bottom surface and a wall surface of each groove 21) is formed into a textured surface of mountain portions 23 and valley portions 24.

Figure 2:
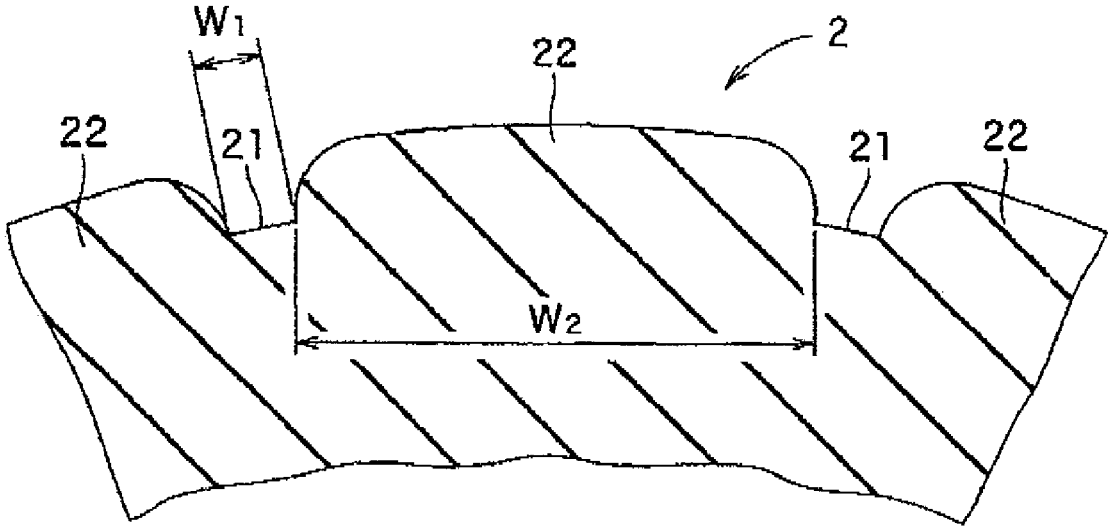
FIG. 2 is an enlarged sectional view illustrating an outer periphery of the sheet feed roller.

The groove-area ratio herein is calculated by a following formula (1). As shown in FIG. 2, each width $W_1$ and each number of the grooves 21, and each width $W_2$ and each number of the convex portions 22 can be obtained by cutting the elastic layer 2 in a thickness direction, magnifying such a cross-section by a microscope or the like and measuring thereof.

$$\text{Groove area ratio}(\%) = \frac{\text{Width } W_1 \text{ of grooves } 21 \times \text{a number of grooves } 21}{\text{Width } W_2 \text{ of convex portions } 22 \times \text{a number of convex portions } 22} \times 100 \quad (1)$$

In detail, a material for forming the elastic layer 2 is not specifically limited. However, general examples thereof include polyurethane, ethylene-propylene-diene rubber (EPDM) and norbornene rubber (NOR) Among them, polyurethane is preferred because of its durability and reliability. An outer diameter thereof is generally 10 to 40 mm and a thickness thereof (a thickness of the convex portions 22) is generally 2 to 10 mm for optimizing dimensions of the elastic layer 2 as a sheet feed roller. The elastic layer 2 preferably has a JIS-A hardness of 30° to 60°, more preferably 45° to 55° for excellent moldability and optimum friction coefficient of the elastic layer 2. Such adjustment of the JIS-A hardness can be conducted by adjusting components of the above mentioned material for forming the elastic layer 2. For example, in the case where the material includes polyetherpolyol (a mixture of polypropylene glycol (PPG) and polytetramethylene ether glycol (PTMG)), polyisocyanate, a chain lengthening agent, a plasticizer and the like, the weight ratio between polytetramethylene ether glycol (PTMG) and polypropylene glycol (PPG) is in the range of PTMG/PPG=95/5 to 60/40 for obtaining the preferable JIS-A hardness (30° to 60°), and the weight ratio therebetween is in the range of PTMG/PPG=80/20 to 70/30 for obtaining the more preferable JIS-A hardness (45° to 55°).

The dimensions and the number of the above-mentioned plural grooves 21 are appropriately arranged in such a manner that the groove area ratio calculated by the above-mentioned formula (1) is within a ratio of 5 to 30% (more preferably 10 to 20%). The dimensions of the grooves 21 depend on an outer diameter of the elastic layer 2 or the like. However, the width ($W_1$) thereof is usually 0.2 to 1.0 mm (preferably 0.4 to 0.7 mm) and the depth thereof is usually 0.2 to 1.5 mm (preferably 0.4 to 1.0 mm). The number of the plural grooves 21 depends on the dimensions of the grooves or the like. The number thereof is usually 10 to 30 grooves (preferably 15 to 25 grooves). Further, the dimensions and the number of the above-mentioned convex portions 22 are automatically determined depending upon the dimensions and the number of the grooves 21.

The textured surface formed on an outer peripheral surface of the elastic layer 2, as shown in FIG. 3, is not specifically limited. However, a ratio $S_1/S_2$ of a total area $S_1$ of the mountain portions 23 to an area $S_2$ of the valley portion 24 is preferably 0.25 to 0.70. When the ratio ($S_1/S_2$) is less than 0.25, contact area between the elastic layer 2 and paper is decreased and thus friction coefficient tends to decrease. When the ratio ($S_1/S_2$) is more than 0.70, crushed powders or paper powders tend to easily attach thereto and thus friction coefficient tends to decrease. In other words, when the ratio ($S_1/S_2$) is outside of the above-mentioned range, friction coefficient of the elastic layer 2 decreases and thus sheet transportation failure easily tends to occur. The area ($S_1$) of the mountain portions 23 and the area ($S_2$) of the valley portion 24 are determined by attaching ink or the like to a textured surface of the elastic layer 2, transferring the ink to a sheet of paper with a load of 2.9N, and measuring the area ($S_1$) of the mountain portions where the ink is attached, and the area ($S_2$) of the valley portions 24 where the ink is not attached, by means of a image processor.

The height H of the mountain portions 23 is preferably 20 to 70 μm and the peak-to-peak distance D of adjoining mountains 23 is preferably 30 to 100 μm. This is because it is difficult for the crushed powders or paper powders to move on the surface of the elastic layer 2 when the height H and the distance 3 are outside of the above-mentioned ranges, respectively. As a result, it is difficult for the crushed powders or paper powders to be incorporated into the grooves 21 or to be eliminated to the outside of the grooves 21, so that the crushed powders or paper powders easily tend to accumulate on the surface of the elastic layer 2. Further, the height H and the distance D of the mountain portions 23 are obtained by cutting the elastic layer 2 in a thickness direction, magnifying such a cross-section by a microscope or the like and measuring thereof.

The hub 1 having a cylindrical shape, as shown in FIG. 1, is not specifically limited and the conventional hub may be used. Exemplary materials for forming the hub 1 include synthetic resin such as polyacetal (POM) acrylonitrile-butadiene-styrene copolymer (ABS), polycarbonate and nylon, and metallic materials such as iron, stainless steel and aluminum. As the dimensions of the hub 1, an outer diameter thereof is usually 7 to 30 mm and a thickness thereof is usually 0.1 to 3.0 mm for optimizing performance of the resultant sheet feed roller.

Now, one example of a method for producing the sheet feed roller of the present invention is described.

First, a mold is produced for forming the elastic layer 2. In detail, a through-hole is formed in a rectangular-solid metallic block and electrical discharge is conducted by a cylindrical electrode having a diameter slightly larger than that of the through-hole. Plural grooves axially extending at specific intervals are circumferentially formed on an outer peripheral surface of the cylindrical electrode. A voltage is applied between the metallic block and the electrode by an electric discharge machine (for example, DIAX VX10 available from Mitsubishi Electric Corporation) while the metallic block and the electrode are relatively oscillated and perpendicularly pushed toward each other. Thereby, an inner peripheral surface of the through-hole is electrically discharged and an inner diameter of the through-hole becomes slightly larger than that of the electrode, and comes to have a shape corresponding to an outer peripheral surface of the electrode and also is formed into a rough surface (for forming a textured surface of the elastic layer 2 by transferring) In this manner, a mold, in which an inner peripheral surface is provided with the grooves and the rough surface, can be produced.

Next, a shaft is set coaxially in the mold and then both opening ends are closed by caps. An unvulcanized rubber for forming an elastic layer 2 is filled into a space defined by the shaft and the inner surface of the mold and the entire mold is put into an oven or the like so as to be heated at predetermined conditions. Thus, a cylindrical cured body (elastic layer 2) is formed on an outer periphery of the shaft. Then, the cylindrical elastic layer 2 is unmolded and is removed from the shaft. The inner peripheral surface of the through-hole of the mold is transferred on the outer peripheral surface of the elastic layer 2, on which plural grooves 21 are axially extended at specific intervals circumferentially on the outer peripheral surface of the elastic layer 2, and a percentage of grooves formed thereon is 10% to 20% and also the surface of the elastic layer 2 is formed into a textured surface.

The sheet feed roller can be produced by cutting the elastic layer 2 into a specific length, and inserting a preliminarily prepared hub 1 into a hollow of the elastic layer 2.

In the production method of the sheet feed roller according to the present invention, in the case for obtaining the elastic layer 2 having an outer diameter of 32 mm, the width ($W_1$) of the groove 21 of 0.5 mm, the depth thereof of 0.5 mm, 24 pieces of grooves 21, the width ($W_2$) of convex portions 22 of 3.5 mm and 22 pieces of convex portions 22, conditions are as follows: a diameter of the through-hole formed in the metallic-block is 30.5 mm, an outer diameter of the cylindrical electrode is 31.9 mm, a width of grooves formed on the outer peripheral surface for the electrode is 0.9 mm, each depth of such grooves is 0.5 mm, each pitch thereof is 15° and surface roughness of the electrical discharge machine is appointed as 40 μm of ten point surface roughness (Rz: JIS B 0601 (1994)).

When the sheet teed roller of the present invention is used in an apparatus such as a copying machine, an adhesive, a primer or the like may be coated on an outer peripheral surface of the hub 1 so that the inner layer 2 may not spin free circumferentially. Alternatively, the hub 1 may have a groove (or grooves) formed axially on its surface.

The sheet feed roller according to the present invention is advantageously employed as a pick-up roller, a feed roller and a separate roller, which are used in a sheet feeder such as a copying machine, a transport roller for transporting paper sheets sent out by a sheet feeder, and also may be employed for a vending machine, an automatic ticket checker, an automatic teller machine, a money changing machine, a counting machine and a cash dispenser.

Next, an explanation will be given to Examples, Experimental Examples, Comparative Examples and Conventional Examples. However, the present invention is not limited to Examples.

EXAMPLES

Examples 1, 2, 2', 2", Experimental Examples 1, 2 and Comparative Examples 1, 2

Preparation of Material (Un-crosslinked Thermosetting Urethane Rubber) for Forming Elastic Layer Urethane prepolymer having an NCO group at an terminal thereof (NCO content: 3.0% by weight, NCO index: 105) was prepared by mixing 70 parts by weight of polytetramethylene ether glycol (PTMG) and 30 parts by weight of polypropylene glycol (PPG) (PREMINOL S 3005 (monool content: 0.8% by weight, Mn: 5000, Number of functional groups: 3, Total an saturation degree: 0.0048 meq/g) available from Asahi Glass Company Ltd.), and defoaming and dehydrating the resultant mixture in vacuo at 80° C. for one hour, and then mixing an appropriate amount of polyisocyanate (tolylene diisocyanate (TDI)) therein for reaction under nitrogen atmosphere at 80° C. for 3 hours. After the thus obtained urethane prepolymer was defoamed in vacuo at 90° C. for 30 minutes, 1.8 parts by weight of a chain lengthening agent (1,4-butanediol (1,4-BD)), 1.5 parts by weight of a chain lengthening agent (trimethylolpropane (TMP)) and 0.01 parts by weight of a catalyst (DBU-formate) were blended therein and were mixed for 2 minutes under reduced pressure with stirring for obtaining un-crosslinked thermosetting urethane rubber. The JIS-A hardness of the thus obtained elastic layer was adjusted into 45° by such preparation.

Production of a Mold for Forming Elastic Layer

A mold was produced by using an electrical discharge machine (for example, DIAX VX10 available from Mitsubishi Electric Corporation) in the same manner as in the above-mentioned embodiment. Each width of grooves on a mold surface and surface roughness thereof were appropriately arranged in each Example, Experimental Example and comparative Example, so that each groove-area ratio on the resultant elastic layer and each textured surface, as shown in the following tables 1 and 2, were obtained.

Production of Sheet Feed Roller

In a similar way to the above-mentioned embodiment, first, a shaft (outside diameter: 17 mm) was set coaxially in a mold and then both opening ends were closed by caps. The un-crosslinked thermosetting urethane rubber for forming the elastic layer was filled into a space defined by the shaft and the inner surface of the mold, and the entire mold was put into an oven so as to be heated at 150° C. for 60 minutes for crosslinking. Thus, a crosslinked and cured body of thermosetting urethane rubber was obtained, which was formed as an elastic layer onto an outer peripheral surface of the shaft, and was unmolded. The elastic layer was removed from the shaft and was cut into a length of 30 mm. In turn, a cylindrical hub (length: 32.5 mm, outer diameter: 18 mm) made of polyacetal (POM) was pressed into a hollow thereof. Thus, the sheet feed rollers of Examples, Experimental Examples and Comparative Examples were obtained. Each elastic layer of the thus obtained sheet teed roller had JIS-A hardness of 45°, an outer diameter of 32 mm, a groove depth of 0.5 mm, 24 pieces of grooves and 24 pieces of convex portions, and each width of grooves and each groove-area ratio were shown in the following tables 1 and 2. The width of grooves was measured by magnifying a cross-section of the elastic layer by a microscope (PV10-CB available from Olympus Corporation), and the groove-area ratio was calculated by such a measured value, an outer diameter (32 mm) of the elastic layer and the number of grooves thereof (24 pieces).

Further, the surface on the elastic layer of the sheet feed roller was formed into a textured surface composed of mountain portions and a valley portion. Each area ratio ($S_1/S_2$) of mountain portions ($S_1$) and the valley portion ($S_2$), each height of mountain portions, each peak-to-peak distance of adjoining mountains were measured, which are shown in the following tables 1 and 2. The height of mountain portions and the peak-to-peak distance were measured by magnifying a cross-section of the elastic layer by a microscope (S-3000N available from Hitachi, Ltd.) and the area ratio ($S_1/S_2$) was measured in the following manner.

Figure 4:
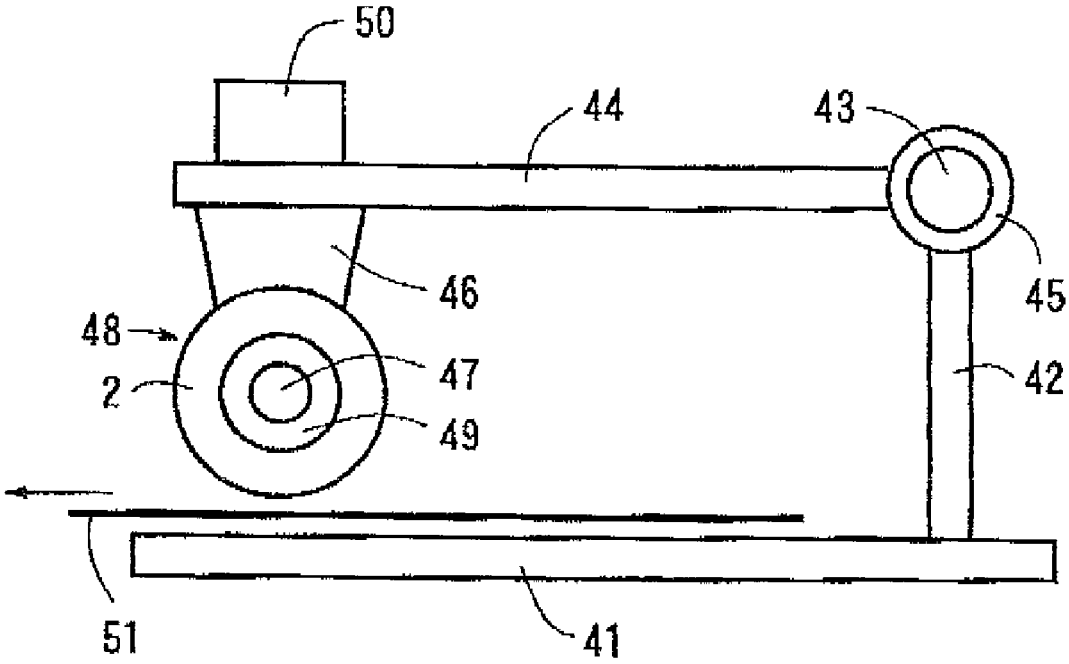
FIG. 4(*a*) is a view illustrating schematically a jig for transferring ink used in a method of measuring a ratio $S_1/S_2$ of a total area $S_1$ of the mountain portions to an area $S_2$ of the valley portion on a textured surface of the sheet feed roller.
Figure 4:
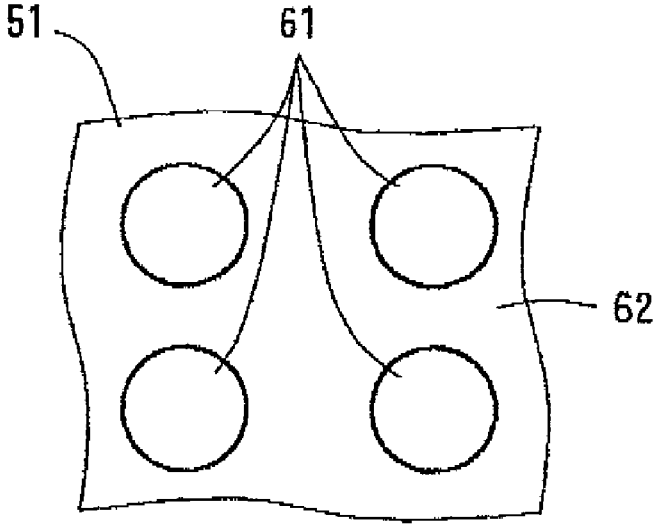

First, an ink transfer jig shown in FIG. 4(*a*) was prepared. In the ink transfer jig, a supporting column 42 stands at a right end of one margin along a longitudinal direction on a rectangular base 41 (or at a distal end of a copy paper 51 (MY PAPER A4 available from NBS Ricoh Co., Ltd.)). An axis 43 extends to the other side of the copy paper 51 from a top of the supporting column 42. A rotating cylinder 45 of an elongated supporting plate 44 is rotatably engaged with the axis 43 whereby the elongated supporting plate 44 is capable of moving vertically centered upon the axis 43. A plate 46 perpendicularly downwardly extends from a lower side of a distal end of the elongated supporting plate 44. A supporting axis 47 extending to the front side as seen in the figure is provided on a lower end of the plate 46. A hollow shaft 49 of a sheet feed roller 48 is rotatably engaged with the supporting axis 47. A weight 50 having a mass of 300 g (load: 2.9 N) is applied onto the distal end of the elongated supporting plate 44.

Next, a planar ink pad (not shown) is positioned under the sheet feed roller 48 rotatably installed with the supporting axis 47 of the ink transfer jig. The ink pad was moved toward the left side as seen in the figure with the weight 50 having a mass of 300 g applied, as shown in the figure. Thereby, the sheet feed roller 48 was rotated along with such a movement. An ink was applied onto a surface of an elastic layer 2, that is an outer peripheral surface of the sheet transfer roller 48, by such a one rotation. Then, the copy paper 51 was positioned under the sheet feed roller 48 applied with ink and the copy paper 51 was slowly pulled out in a direction as shown by an arrow, so that the sheet feed roller 48 was rotated along with such a movement. As a result, the ink (available from Shachihata Inc., a special ink for the ink pad, a pigment: SG-40 (color)) was transferred on a surface of the copy paper 51, and thus an ink transferred paper, as shown in FIG. 4(*b*), was obtained.

The thus obtained ink transferred paper was processed by a binary image processor (SPICA II available from Nippon Avionics Co., Ltd.). An area of an ink-transferred portion 61 ($S_1$: a sum of areas within circles, as shown) on the copy paper 51 was obtained and then a ratio ($S_1/S_2$) to an area of non-inked portion 62 ($S_2$) was calculated.

Examples 3 to 6

Examples 3 to 6 were prepared in the same manner as in the above Examples 1, 2, 2', 2" and Experimental Examples 1, 2, except that each JIS-A hardness of the intended elastic layers was changed in each Example by changing the weight ratio (PTMG/PPG) of PTMG and PPG to be mixed was changed as shown in the following table 3.

Conventional Example 1

A conventional sheet feed roller including a polyurethane elastic layer, and having a textured outer peripheral surface, however, not having grooves on the outer peripheral surface, was prepared as Conventional Example 1. A ratio $S_1/S_2$ of a total area $S_1$ of the mountain portions to an area $S_2$ of the valley portion on a textured surface, each height of mountains and each peak-to-peak distance of adjoining mountains were measured, which are shown in the following tables 1 and 2.

Conventional Example 2

A conventional sheet feed roller including an EPDM-made elastic layer, and having a textured outer peripheral surface, however, not having grooves on the outer peripheral surface, was prepared as Conventional Example 2. A ratio $S_1/S_2$ of a total area $S_1$ of the mountain portions to an area $S_2$ of the valley portion on a textured surface was not measured.

Measurement of Friction Coefficient

Figure 5:
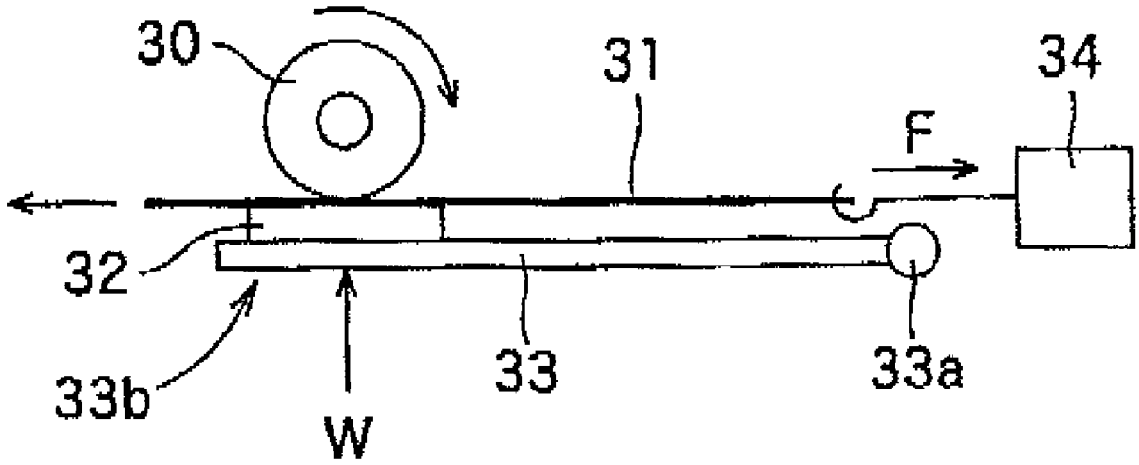
FIG. 5 is a view schematically illustrating a method of measuring a friction coefficient of an outer peripheral surface of an elastic layer of the sheet feed roller.

For each of the sheet feed rollers of the thus obtained Examples 1 to 6, Experimental Examples 1 to 2, Comparative Examples 1 to 2 and Conventional Examples 1 to 2, the friction coefficient on an outer peripheral surface was measured, before the below-mentioned durability test was conducted (as initial friction coefficient) and after thereof. However, as for each of the Examples 3 to 6, only initial friction coefficient was measured. The friction coefficient was measured in the manner as shown in FIG. 5. A paper sheet for PPC (plain paper copier) 31 was pressed onto a sheet feed roller 30 through a Teflon (trademark) sheet 32 at a load (W) of 2.94N applied from beneath by a flat plate 33. The flat plate 33 was rotatable on a distal end 33*a* as an axis in parallel with an axis of the sheet feed roller 30, while the Teflon (trademark) sheet 32 was fixed on a surface on the other distal end 33*b* of the flat plate 33 so as to play a role to slide the paper for PPC 31. In the meantime, one end of the paper for PPC 31 was connected with a load cell 34, while the sheet feed roller 30 was rotated at a circumferential velocity of an outer periphery of the sheet feed roller 30 of 180 mm/sec., so that the paper for PPC 31 came off the load cell 34. The pull force (F: unit N) applied when the sheet feed roller 30 was sliding on the paper for PPC 31 was measured by the load cell 34, and the friction coefficient ($\mu$=F/W) was calculated. The results are also shown in the following tables 1 to 3. Further, as for the measurement after durability test (except for the Examples 3 to 6), in the case where the sheet feed roller 30 had reached the end of its life (could not transfer the paper), such a measurement was conducted at that time. In the case where the sheet feed roller 30 had not reached the end of its life after transportation of 200,000 sheets of paper, such a measurement was conducted after that.

Durability Test

The sheet feed rollers were each Incorporated as a pick-up roller in a bench tester having a three-roller FRR (Feed and Reverse Roller) sheet feed system, and paper sheets were transported. The pick-up roller was brought into a contact with piled-up many sheets of paper, so that the uppermost sheet of paper was sent out by the rotation of the pick-up roller and passed through between a feed roller and a separate roller, which were rotated in press contact therebetween in front of the pick-up roller. The paper sheets to be used in the above test were obtained by color printing on OK Topkote papers (available from Oji Paper Co., Ltd.) and scattering crushed powders on a surface thereof. The number of paper sheets was counted when a paper sheet was not transported. In the case where sheet transportation failure did not occur after transportation of 200,000 paper sheets, the durability test was stopped at that time. The results are also shown in the following tables 1 and 2.

Moldability of Elastic Layer

Each moldability of the Examples 1 and 3 to 6 was evaluated. In the case where urethane cured material (an elastic layer including a shaft) could be easily unmolded after curing in a mold for a specific time, its evaluation was excellent (◎), while in the case where urethane cured material (an elastic layer including a shaft) could be unmolded with slight difficulty after curing in a mold for a specific time, its evaluation was good (○). The results are shown in the following table 3.

Overall Evaluation on Durability Test and Friction Coefficient After Durability Test In the case where friction coefficient after durability test was 1.6 in the following tables 1 and 2 and sheet transportation failure did not occur after transportation of 200,000 paper sheets, overall evaluation was excellent (◎), and in the case where friction coefficient after durability test in the same tables was less than 1.6, however, sheet transportation failure did not occur after transportation of 200,000 paper sheets, overall evaluation was good (○), and in the case where friction coefficient after durability test was less than 1.2 in the same tables and sheet transportation failure occurred prior to transportation of 100,000 paper sheets, overall evaluation was poor (X). The results are also shown in the following tables 1 and 2.

Overall Evaluation on Moldability of Elastic Layer and Friction Coefficient After Durability Test In the case where initial friction coefficient was 1.8 in the following table 3 and moldability of the elastic layer was particularly preferred (evaluated as ◎, overall evaluation was excellent (◎), and in the case where initial friction coefficient was less than 1.8 in the same table, or moldability of the elastic layer was good (evaluated as ○), overall evaluation was good (○) The results are also shown in the following table 3.

TABLE 1

| | EXPERIMENTAL EXAMPLE | EXAMPLE | | | | EXPERIMENTAL EXAMPLE |
|---|---|---|---|---|---|---|
| | 1 | 1 | 2 | 2' | 2" | 2 |
| Material for forming elastic layer | Urethane | | | | | |
| JIS-A hardness (°) | 45 | | | | | |
| Width of grooves (mm) | 0.2 | 0.4 | 0.7 | 0.4 | 0.4 | 1.0 |
| Groove-area ratio (%) | 5 | 10 | 20 | 10 | 10 | 30 |
| $S_1/S_2$ | 0.50 | | | 0.25 | 0.70 | 0.50 |
| | Mountain portions | | | | | |
| Height (μm) | 50 | | | 70 | 20 | 50 |
| Peak-to-peak distance (μm) | 70 | | | 100 | 30 | 70 |
| | Friction coefficient | | | | | |
| Initial | 1.8 | | | | | |
| After durability test | 1.5 | 1.6 | | | | 1.5 |
| Durability test result | Termination of durability test after successful transportation of 200,000 paper sheets | | | | | |
| Overall evaluation | ○ | ◎ | ◎ | ◎ | ◎ | ○ |

TABLE 2

| | COMPARATIVE EXAMPLE | | CONVENTIONAL EXAMPLE | |
|---|---|---|---|---|
| | 1 | 2 | 1 | 2 |
| Material for forming elastic layer | Urethane | | | EPDM |
| JIS-A hardness (°) | 45 | | | |
| Width of grooves (mm) | 0.1 | 1.2 | — | |
| Groove-area ratio (%) | 2 | 40 | 0 | |
| $S_1/S_2$ | 0.50 | | | — |
| | Mountain portions | | | |
| Height (μm) | 50 | | | — |
| Peak-to-peak distance (μm) | 70 | | | — |
| | Friction coefficient | | | |
| Initial | 1.8 | 1.4 | 1.8 | |
| After durability test | 1.1 | | 1.0 | 0.8 |
| Durability test result | Reached end of life at 80,000 paper sheets | Reached end of life at 70,000 paper sheets | Reached end of life at 70,000 paper sheets | Reached end of life at 5,000 paper sheets |
| Overall evaluation | X | X | X | X |

TABLE 3

| | EXAMPLE | | | | |
|---|---|---|---|---|---|
| | 3 | (1) | 4 | 5 | 6 |
| Material for forming elastic layer | Urethane | | | | |
| PTMG/PPG | 65/35 | 70/30 | 75/25 | 80/20 | 90/10 |
| JIS-A hardness (°) | 30 | 45 | 50 | 55 | 60 |
| Groove-area ratio (%) | 10 | | | | |
| Friction coefficient | | | | | |
| Initial | 1.8 | | | | 1.7 |
| Moldability of elastic layer | ○ | ◎ | ◎ | ◎ | ◎ |
| Overall evaluation | ○ | ◎ | ◎ | ◎ | ○ |

As can be understood from the results shown in Tables 1 and 2, sustainability of sheet feeding capability was remarkably lengthened in the sheet feed rollers of the Examples 1, 2, 2' and 2" as compared with those of the Experimental Examples 1 to 2, Comparative Examples 1 to 2 and Conventional Examples 1 to 2. Further, it is found that each friction coefficient of the sheet feed rollers was difficult to decrease even after prolonged time of use in the Examples 1, 2, 2' and 2". Even further, it is found from the results of Table 3 that moldability of the elastic layer was excellent and also friction coefficient was great if the TIS-A hardness of the elastic layer is within a range of 30° to 60°. Especially, the sheet feed rollers of the Examples 1, 4 and 5 (in which JIS-A hardness is 45° to 55°), moldability of the elastic layer and friction coefficient were even further preferred.

What is claimed is:

1. A sheet feed roller comprising a hub and an elastic layer provided on an outer peripheral surface of the hub, wherein plural grooves axially extend at specific intervals circumferentially on an outer peripheral surface of the elastic layer, a textured surface comprising mountain portions and a valley portion is formed on an outer peripheral surface of the elastic layer except for the grooves, and on bottom surfaces and wall surfaces of the grooves, a ratio of a total area of the bottom surfaces of the grooves to a total area except for the grooves on the outer peripheral surface of the elastic layer is 10% to 20%, wherein the mountain portions of the textured surface each have a height of 20 to 70 μm and a peak-to-peak distance of the adjoining mountain portions is 30 to 100 μm.

2. A sheet feed roller according to claim 1, wherein a ratio $S_1/S_2$ of a total area $S_1$ of the mountain portions to an area $S_2$ of the valley portion is 0.25 to 0.70.

3. A sheet feed roller according to claim 1, wherein each width $W_1$ of the grooves is 0.4 to 0.7 mm.

4. A sheet feed roller according to claim 1, which is used to supply color printed papers.

5. A sheet feed roller comprising a hub and an elastic layer provided on an outer peripheral surface of the hub, wherein plural grooves axially extend at specific intervals circumferentially on an outer peripheral surface of the elastic layer, a textured surface comprising mountain portions and a valley portion is formed on an outer peripheral surface of the elastic layer except for the grooves, and on bottom surfaces and wall surfaces of the grooves, a ratio of a total area of the bottom surfaces of the grooves to a total area except for the grooves on the outer peripheral surface of the elastic layer is 10% to 20%, wherein the elastic layer is formed by a cured body of thermosetting urethane rubber obtained by reacting a chain lengthening agent and an urethane prepolymer obtained by reacting a mixture of polytetramethylene ether glycol (PTMG) and polypropylene glycol (PPG) by a ratio of PTMG/PPG=70 to 80/30 to 20 with polyisocyanate.

6. A sheet feed roller according to claim 5, wherein the mountain portions of the textured surface each have a height of 20 to 70 μm and a peak-to-peak distance of the adjoining mountain portions is 30 to 100 μm.

7. A sheet feed roller according to claim 5, wherein a ratio $S_1/S_2$ of a total area $S_1$ of the mountain portions to an area $S_2$ of the valley portion is 0.25 to 0.70.

8. A sheet feed roller according to claim 5, wherein each width $W_1$ of the grooves is 0.4 to 0.7 mm.

9. A sheet feed roller according to claim 5, which is used to supply color printed papers.

* * * * *